US006797080B2

(12) United States Patent
Mori et al.

(10) Patent No.: US 6,797,080 B2
(45) Date of Patent: Sep. 28, 2004

(54) METHOD FOR PRODUCING SPRAYING MATERIAL

(75) Inventors: Makoto Mori, Nagano (JP); Naoya Komabayashi, Nagano (JP); Hisashi Morimoto, Hyogo (JP)

(73) Assignee: Showa Denko Kabushiki Kaisha, Tokyo (JP)

( * ) Notice: Subject to any disclaimer, the term of this patent is extended or adjusted under 35 U.S.C. 154(b) by 151 days.

(21) Appl. No.: 10/190,627

(22) Filed: Jul. 9, 2002

(65) Prior Publication Data

US 2003/0049387 A1 Mar. 13, 2003

Related U.S. Application Data

(60) Provisional application No. 60/304,744, filed on Jul. 13, 2001.

(30) Foreign Application Priority Data

Jul. 9, 2001 (JP) ..... P2001-208093

(51) Int. Cl.[7] ..... C22F 1/11; C22F 9/04

(52) U.S. Cl. ..... 148/513; 148/668; 75/352; 75/360

(58) Field of Search ..... 75/352, 357, 360; 148/513, 514, 668

(56) References Cited

U.S. PATENT DOCUMENTS 4,290,808 A * 9/1981 Ray ..... 148/403
5,123,957 A * 6/1992 Kato et al. ..... 148/513
2003/0136224 A1 * 7/2003 Sanger et al. ..... 75/352

FOREIGN PATENT DOCUMENTS

DE 10002738 A1 * 7/2001
JP 61-257775 A * 11/1986

* cited by examiner

*Primary Examiner*—George Wyszomierski
(74) *Attorney, Agent, or Firm*—Sughrue Mion, PLLC

(57) ABSTRACT

When a chromium-iron-based alloy, preferably a chromium-iron-based alloy having a chromium content of about 60 to about 95 mass % is subjected to heat treatment at about 500 to about 1,300° C., and subsequently to grinding treatment by use of an impact mill, grindability of the chromium-iron-based alloy is improved, and running cost can be reduced. In addition, the resultant powdery thermal spraying material exhibits stable fluidity during spray coating, and thus a uniform coating can be formed.

10 Claims, 2 Drawing Sheets

METHOD FOR PRODUCING SPRAYING MATERIAL

CROSS REFERENCE TO RELATED APPLICATION

The present application claims the benefits, pursuant to 35 U.S.C. §119(e), of Provisional Application No. 60/304,744 filed Jul. 13, 2001 pursuant to 35 U.S.C. §111(b).

TECHNICAL FIELD

The present invention relates to a method for producing a chromium-iron-based thermal spraying material employed in corrosion-resistant members.

BACKGROUND ART

Spray coating is a technique widely utilized in industry for improving the quality of surfaces of substrates, and is employed for imparting corrosion resistance, wear resistance, and heat resistance to members of airplane engines, power-generating gas turbines, paper-making machines, iron or steel rolls, and other products. In spray coating, a thermal spraying material, which is generally in the form of powder, is instantaneously melted by use of a high-temperature heat source, and the thus-melted material is solidified and deposited onto the surface of an object, to thereby form a coating on the object. In accordance with the heat source employed for melting a thermal spraying material, spray coating is roughly classified into a combustion gas type in which a fuel such as propylene, acetylene, or kerosene is combusted in the presence of air or oxygen; and a plasma spraying type employing, for example, argon, hydrogen, helium, or nitrogen. These types are appropriately employed in accordance with the purpose of spray coating.

As compared with other coating methods, such as plating, spray coating is more advantageous in that (1) coating is formed at a high rate, (2) a substrate undergoes minimal thermal deformation, since a plating frame is not brought into direct contact with the substrate, and (3) the size of a substrate is not limited by the dimension of a plating bath, thereby facilitating coating of a substrate having a large area. Therefore, spray coating is used in practice for preventing corrosion or rusting of large-sized structures, such as steel towers, iron bridges, steel frames, ships, and containers employed in chemical industries.

Examples of thermal spraying materials which are used in practice include aluminum, zinc, zinc-aluminum alloys, chromium-iron-based alloys, nickel-chromium alloys, CoCrAlY alloys, and NiCrAlY alloys. Of these, chromium-iron-based alloys are employed for providing corrosion resistance. For example, when a chromium-iron-based alloy film is formed through spray coating on the inner wall of a sodium-sulfur battery positive electrode container, the battery container can be protected from a corrosive active substance.

Conventional chromium-iron-based alloy thermal spraying materials are generally produced by grinding a chromium-iron-based alloy ingot, and subjecting the thus-ground ingot to classification.

A grinding machine such as a vibration mill or an attritor is generally employed for production of chromium-iron-based alloy thermal spraying materials. A chromium-iron-based alloy thermal spraying material having a particle size of about some hundreds of $\mu$m is easily produced through grinding. However, a chromium-iron-based alloy thermal spraying material having a particle size of 100 $\mu$m or less is difficult to produce through grinding, due to toughness of chromium-iron alloy. Excessive grinding causes wear of the interior of a grinding machine, along with contamination of the resultant thermal spraying material with impurities. When a chromium-iron-based thermal spraying material having a particle size of 100 $\mu$m or less is produced through a conventional grinding method, particles of the resultant thermal spraying material tend to have a flat shape. Therefore, such thermal spraying material is not suitable for spray coating, which requires fluidity of particles.

DISCLOSURE OF THE INVENTION

The present inventors have performed studies on grinding treatment of a chromium-iron-based alloy, and have found that when a chromium-iron alloy is subjected to heat treatment, the alloy becomes brittle, and that when the resultant alloy is subjected to grinding treatment, fine powder can be formed, and the thus-formed powder has a shape suitable for spray coating. The present invention has been accomplished on the basis of this finding. Accordingly, the present invention provides the following.

(1) A method for producing a chromium-iron-based thermal spraying material characterized by comprising subjecting a chromium-iron-based alloy to heat treatment, and subsequently subjecting the heat-treated alloy to grinding treatment.

(2) A method for producing a chromium-iron-based thermal spraying material according to (1), wherein the chromium-iron-based alloy comprises an alloy having a chromium content of 60 to 95 mass %.

(3) A method for producing a chromium-iron-based thermal spraying material according to (1) or (2), wherein the chromium-iron-based alloy is in the form of particles having a size of 5 $\mu$m to 1 mm in diameter.

(4) A method for producing a chromium-iron-based thermal spraying material according to any one of (1) through (3), wherein the heat treatment of the chromium-iron-based alloy is carried out in an atmosphere of hydrogen gas or an inert gas.

(5) A method for producing a chromium-iron-based thermal spraying material according to (4), wherein the inert gas is argon.

(6) A method for producing a chromium-iron-based thermal spraying material according to any one of (1) through (5), wherein the heat treatment of the chromium-iron-based alloy is carried out at 500 to 1,300° C.

(7) A method for producing a chromium-iron-based thermal spraying material according to any one of (1) through (6), wherein the grinding treatment is carried out by use of an impact mill.

(8) A method for producing a chromium-iron-based thermal spraying material according to (7), wherein the impact mill includes a liner section having bar-like, wear-resistant members which are arranged to form a grating.

(9) A method for producing a chromium-iron-based thermal spraying material according to (8), wherein the bar-like, wear-resistant members are formed from any one material selected from among zirconia, yttria-stabilized zirconia, calcia-stabilized zirconia, magnesia-stabilized zirconia, alumina, alumina-zirconia, silicon carbide, silicon nitride, and a tungsten carbide-cobalt alloy.

(10) A method for producing a chromium-iron-based thermal spraying material according to any one of (1)

through (9), wherein a thermal spraying material produced through the method has a particle size of 5 to 100 μm.

(11) A method for producing a chromium-iron-based thermal spraying material according to any one of (1) through (10), wherein a thermal spraying material produced through the method has an apparent density as specified by JIS (Z2504) of 2.8 to 3.5 g/cm$^3$.

(12) A chromium-iron-based thermal spraying material having a chromium content of 60 to 95 mass %, a particle size of 5 to 100 μm, and an apparent density as specified by JIS (Z2504) of 2.8 to 3.5 g/cm$^3$.

DESCRIPTION OF REFERENCE NUMERALS

Figure 1:
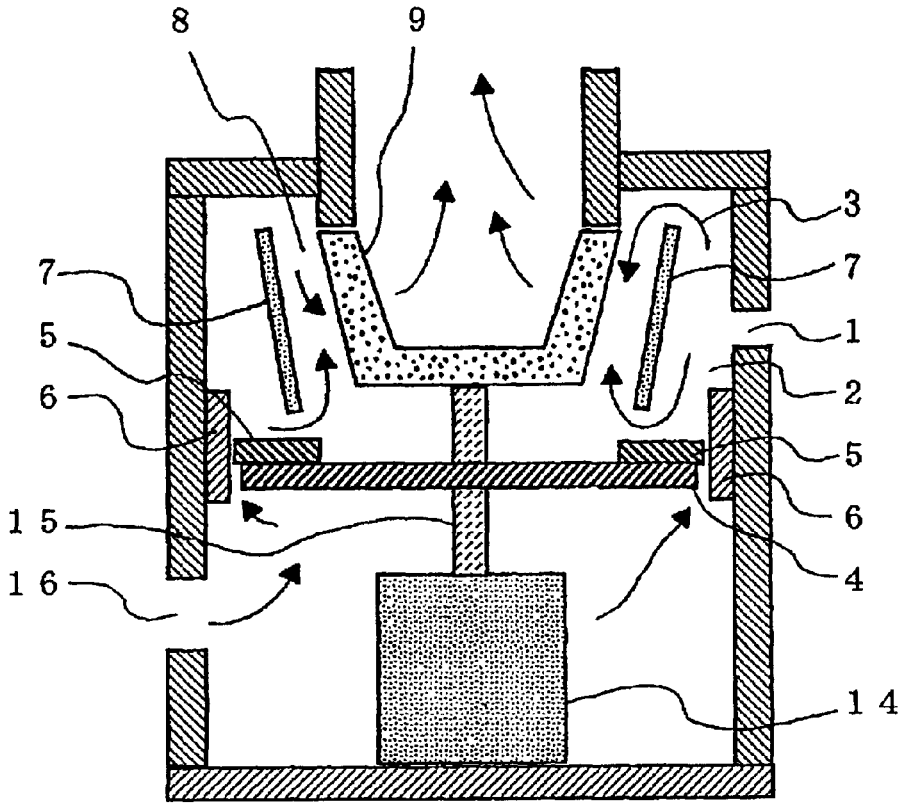
FIG. 1 is a schematic representation showing an example of an impact mill employed in the present invention.

1. Feed inlet
2. Grinding chamber
3. Airflow
4. Grinding rotor
5. Grinding hammer section
6. Liner
7. Guide ring
8. Classification zone
9. Classification apparatus
10. Grinding rotor
11. Liner
12. Bar-like, wear-resistant member
13. Wear-resistant member
14. Motor
15. Motor shaft
16. Air inlet

DETAILED DESCRIPTION OF THE INVENTION

A characteristic feature of the method for producing a thermal spraying material of the present invention resides in that a chromium-iron-based alloy is subjected to heat treatment, and subsequently the heat-treated alloy is subjected to grinding treatment.

Examples of the chromium-iron-based alloy include Cr—Fe alloys, Cr—Fe—Ni alloys, Cr—Fe—Al alloys, Cr—Fe—Ni—Al alloys, and alloys containing such an alloy and an element such as C, Si, Mn, Cu, Mo, Zn, Ti, Zr, Nb, Hf, Ta, W, Re, Ge, or O.

The chromium-iron-based alloy employed in the present invention preferably has a chromium content of about 60 to about 95 mass %, more preferably about 70 to about 90 mass %. The present inventors have performed studies on grindability of a heat-treated chromium-iron-based alloy, and have found that the chromium content of a chromium-iron-based alloy affects grindability of the alloy. Specifically, when the chromium content of a chromium-iron-based alloy is less than about 60 mass %, toughness of the alloy increases, and therefore, even when the alloy is subjected to heat treatment, improvement in grindability of the alloy is insufficient. In contrast, when the chromium content of a chromium-iron-based alloy exceeds about 95 mass %, grindability of the alloy becomes excessively high, and the resultant powder has lowered toughness and a flat shape unsuitable for spray coating.

The present inventors have also found that the carbon content of a chromium-iron-based alloy greatly affects grindability of the alloy. Specifically, when the carbon content of a chromium-iron-based alloy exceeds about 8 mass %, grindability of the alloy becomes high, and the resultant powder has a flat shape unsuitable for spray coating.

The chromium-iron-based alloy employed in the present invention is preferably in the form of particles, in consideration of heat treatment and grinding treatment of the alloy. The particle size of the alloy is preferably about 5 μm to about 1 mm in diameter, more preferably about 5 μm to about 300 μm.

As used herein, the term "heat treatment" refers to a process including the steps of heating a chromium-iron alloy to a predetermined temperature, maintaining the alloy at the temperature for a predetermined period of time, and cooling the thus-heated alloy to room temperature. No particular limitation is imposed on the temperature increase rate and the temperature decrease rate employed during the heat treatment.

In the present invention, preferably, heat treatment is carried out in an atmosphere of hydrogen gas or an inert gas at a temperature of about 500 to about 1,300° C. When the chromium-iron-based alloy of the present invention is subjected to heat treatment under the above conditions, the alloy undergoes thermal embrittlement or hydrogen embrittlement, and a powder having a shape and a size suitable for spray coating is easily produced. No particular limitation is imposed on the inert gas to be employed, so long as the inert gas does not react with the chromium-iron-based alloy during heat treatment. For example, argon gas is preferably employed. Employment of nitrogen gas is unsuitable, since it reacts with the chromium-iron-based alloy during heat treatment.

The heat treatment temperature is preferably about 500 to about 1,300° C., more preferably about 800 to about 1,000° C. When the heat treatment temperature is lower than about 500° C., the chromium-iron-based alloy embrittles insufficiently, and improvement in grindability is unsatisfactory. In contrast, when the heat treatment temperature exceeds about 1,300° C., the chromium-iron-based alloy per se tends to be sintered during heat treatment, and difficulty is encountered in subsequent grinding of the heat-treated alloy.

During heat treatment, the chromium-iron-based alloy is preferably maintained at the aforementioned temperature for about one to about 10 hours, more preferably for about three to about six hours.

Grinding treatment of the heat-treated chromium-iron-based alloy is preferably carried out by use of an impact mill.

The impact mill is a machine having a mechanism in which powder is introduced into the apparatus by means of, for example, airflow, and impact is applied to the powder by a hammer (grinding hammer) against a liner, to thereby grind the powder. In general, liners are classified into two types: a smooth liner and a grooved liner having grooves on the inner wall thereof for attaining high grindability. A grooved liner is superior to a smooth liner in terms of grindability. In general, an impact mill includes a liner formed of a metallic material, but such a liner formed of a metallic material exhibits poor wear resistance when employed for grinding the chromium-iron-based alloy of the present invention. Therefore, a member of the liner is worn during grinding, whereby the resultant thermal spraying material is contaminated with impurities.

The impact mill employed in the present invention includes a liner section having bar-like, wear-resistant members which are arranged to form a grating. Therefore, wear resistance, grinding efficiency, and grindability of the impact mill can be improved, and the amount of impurities contained in the resultant thermal spraying material can be reduced.

Examples of the material employed for forming the bar-like, wear-resistant members include super-hard materials such as zirconia, yttria-stabilized zirconia, calcia-stabilized zirconia, magnesia-stabilized zirconia, aluminum oxide, alumina-zirconia, silicon carbide, silicon nitride, tungsten carbide-cobalt, tungsten carbide-cobalt chromium, and tungsten carbide-nickel chromium. Of these, zirconia-based materials, such as zirconia, yttria-stabilized zirconia, calcia-stabilized zirconia, magnesia-stabilized zirconia, and alumina-zirconia, are preferably employed for forming the bar-like, wear-resistant members of the impact mill employed in the present invention. The liner section of the impact mill on which the bar-like, wear-resistant members are provided is preferably formed from a material which firmly supports the wear-resistant members and which is not deformed considerably during grinding. Preferred examples of the material include iron-based metals and stainless-steel-based metals.

In the present invention, wear-resistant members are preferably employed in the grinding hammer section of the impact mill. Examples of the material employed for forming the wear-resistant members include super-hard materials such as zirconia, yttria-stabilized zirconia, calcia-stabilized zirconia, magnesia-stabilized zirconia, aluminum oxide, alumina-zirconia, silicon carbide, silicon nitride, tungsten carbide-cobalt, tungsten carbide-cobalt chromium, and tungsten carbide-nickel chromium. Of these, tungsten-carbide based materials such as tungsten carbide-cobalt, and zirconia-based materials yttria-stabilized zirconia are preferably employed for forming the wear-resistant members. The grinding rotor section on which the grinding hammer section is provided is preferably formed from a material which firmly supports the wear-resistant members and which does not undergo considerable deformation during grinding. Preferred examples of the material include iron-based metals and stainless-steel-based metals.

FIG. 1 schematically shows a specific example of the impact mill employed in the present invention. However, the impact mill employed in the present invention is not limited to this example.

Chromium-iron-based alloy powder is fed through an inlet 1 to a grinding chamber 2, the powder is introduced to a grinding rotor 4 by means of airflow 3, and impact is applied to the powder by a grinding hammer section 5 against a liner 6, to thereby grind the powder. The thus-ground powder flows along the outer wall of a guide ring 7 and is introduced to a classification zone 8. Fine powder passes through a classification apparatus 9 to the outside of the mill. Meanwhile, large powder returns to the grinding rotor 4 after flowing along the inner wall of the guide ring 7, and is then subjected to grinding. Thus, powder which cannot pass through the classification apparatus is subjected to repeated grinding, and only fine powder having a predetermined classification size or less passes through the classification apparatus 9 to the outside of the mill.

Figure 2:
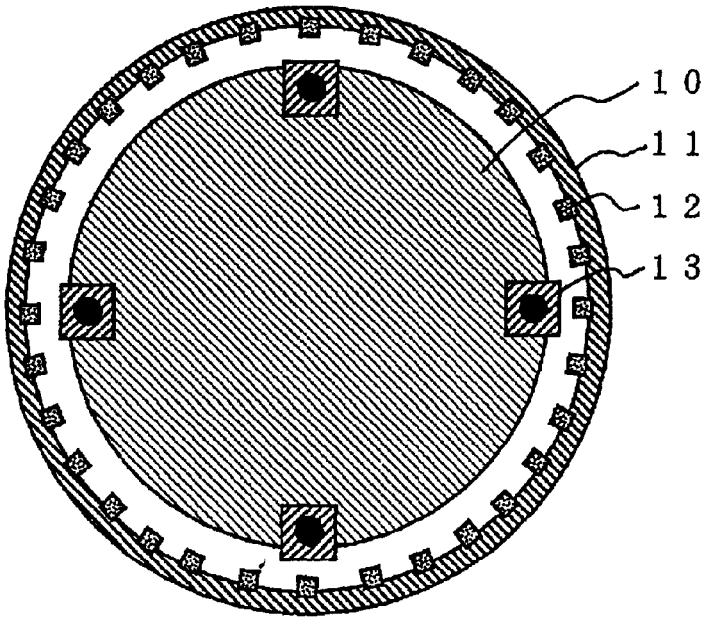
FIG. 2 is a schematic top view showing a grinding rotor and a liner of the impact mill employed in the present invention.

FIG. 2 is a schematic top view showing a grinding rotor 10 and a liner 11. Preferably, bar-like, wear-resistant members 12 are provided on the inner wall of the hollow-cylindrical liner 11 of the impact mill employed in the present invention, such that the bar-like, wear-resistant members 12 are arranged to form a grating. No particular limitation is imposed on the shape of each of the bar-like, wear-resistant members 12, so long as the length of the member does not exceed the height of the liner. For example, the member may have a simple rectangular parallelepiped shape. The bar-like, wear-resistant members 12 having such a shape are provided on the inner wall of the liner, such that the intervals between the members become uniform. Preferably, the intervals between the bar-like, wear-resistant members are determined such that the metallic liner is not considerably worn by the ground powder.

Wear-resistant members 13 are preferably provided in a well-balanced manner on the upper surface of the grinding rotor 10, such that the grinding rotor 10 can be rotated without causing deflection in center of gravity.

The minimal distance between each of the bar-like, wear-resistant members 12 provided on the inner wall of the liner and each of the wear-resistant members 13 provided on the grinding rotor is about 0.1 to about 5 mm, preferably about 0.5 to about 2 mm.

No particular limitation is imposed on the method for fixing of the wear-resistant members 12 and 13, so long as the members do not fall during operation of the mill. In general, an adhesive such as epoxy resin is employed for fixing of the members. Fixing of the members may be carried out by means of a physical fixing method employing, for example, screws.

The classification mechanism of the impact mill employed in the present invention may be a generally used classification mechanism. Preferably, a rotation-type classification separator or a mesh-type classification apparatus is employed.

The chromium-iron-based thermal spraying material produced through the method of the present invention has a particle size of about 5 to about 100 $\mu$m, preferably about 5 to about 63 $\mu$m. When the particle size of the thermal spraying material exceeds about 100 $\mu$m, the thermal spraying material is insufficiently melted in a spray coating frame during spray coating, and efficiency in deposition of the material onto a substrate is lowered. In addition, a coating formed through spray coating has a porous structure, which is not preferred from the viewpoint of corrosion resistance. In contrast, when the particle size of the thermal spraying material is less than 5 $\mu$m, fluidity of the powdery thermal spraying material is lowered, and thus the quality of a coating formed through spray coating becomes non-uniform. In addition, since the powdery thermal spraying material is easily oxidized, the quality of the coating is deteriorated.

The chromium-iron-based thermal spraying material produced through the method of the present invention is in the form of powder, and has an apparent density as specified by JIS (Z2504) of about 2.8 to about 3.5 g/cm$^3$. Therefore, when the thermal spraying material is employed, a highly dense coating is formed through spray coating, and the coating exhibits high corrosion resistance.

The apparent density as specified by JIS (Z2504) is measured through the following procedure. A sample (powder) is placed in a dried container, and maintained at 105±5° C. for one hour. Subsequently, the container is cooled to room temperature in a desiccator. The sample is removed from the container immediately before measurement. The sample is poured into a funnel having an orifice of 2.5 mm until the sample discharged from the funnel overflows a cylindrical cup (inner diameter: 28 to 30 mm, volume: 25±0.05 $cm^3$). Addition of the sample is stopped immediately after the sample overflows the cup. Subsequently, without vibrating the cup, the powder that stands above the rim of the cup is removed by use of a scoop such that the level of the powder becomes flush with the upper end of the cup. Thereafter, the side of the cup is tapped to thereby settle the powder, the powder deposited onto the outside of the cup is removed, and the mass of the powder contained in the cup is weighed with an accuracy of 0.05 g, to thereby calculate the apparent density.

BEST MODE FOR CARRYING OUT THE INVENTION

The present invention will next be described in detail by way of Examples, which should not be construed as limiting the invention thereto.

COMPARATIVE EXAMPLE 1

A chromium-iron alloy source (Cr content: 75%) containing particles having a size of 106 μm or less in an amount of 39 mass % and particles having a size of 75 μm or less in an amount of 14 mass % was subjected to grinding treatment without being subjected to heat treatment. The chromium-iron alloy source (1 Kg) was placed in a metallic ball mill (size: 180ϕ×180) containing 17-ϕ balls formed of S45C (8.5 Kg), the atmosphere of the ball mill was substituted by argon gas, and the alloy source was subjected to grinding for 10 hours. After completion of grinding, the thus-ground product was removed from the ball mill, and the amounts (mass %) of particles having a size of 106 μm or less and particles having a size of 75 μm or less were measured. The measurement results are shown in Table 1.

EXAMPLE 1

A chromium-iron alloy source (Cr content: 75%) similar to that employed in Comparative Example 1 was placed in an atmospheric furnace, and subjected to heat treatment in an argon gas atmosphere at 500° C. for four hours. After the furnace was cooled, the chromium-iron alloy source was removed. In a manner similar to that of Comparative Example 1, the alloy source (1 Kg) was placed in a metallic ball mill (size: 180 ϕ×180) containing 17-ϕ balls formed of S45C (8.5 Kg), the atmosphere of the ball mill was substituted by argon gas, and the alloy source was subjected to grinding for 10 hours. After completion of grinding, the thus-ground product was removed from the ball mill, and the amounts (mass %) of particles having a size of 106 μm or less and particles having a size of 75 μm or less were measured in a manner similar to that of Comparative Example 1. The measurement results are shown in Table 1.

EXAMPLE 2

The same chromium-iron alloy source as employed in Example 1 was placed in an atmospheric furnace, and subjected to heat treatment in an argon gas atmosphere at 600° C. for four hours. Subsequently, the resultant alloy source was subjected to grinding treatment under the same conditions as those of Example 1. The amounts of particles were measured in a manner similar to that of Example 1. The results are shown in Table 1.

EXAMPLE 3

The same chromium-iron alloy source as employed in Example 1 was placed in an atmospheric furnace, and subjected to heat treatment in an argon gas atmosphere at 850° C. for four hours. Subsequently, the resultant alloy source was subjected to grinding treatment under the same conditions as those of Example 1. The amounts of particles were measured in a manner similar to that of Example 1. The results are shown in Table 1.

EXAMPLE 4

The same chromium-iron alloy source as employed in Example 1 was placed in an atmospheric furnace, and subjected to heat treatment in an argon gas atmosphere at 950° C. for four hours. Subsequently, the resultant alloy source was subjected to grinding treatment under the same conditions as those of Example 1. The amounts of particles were measured in a manner similar to that of Example 1. The results are shown in Table 1.

EXAMPLE 5

The same chromium-iron alloy source as employed in Example 1 was placed in an atmospheric furnace, and subjected to heat treatment in an argon gas atmosphere at 1,050° C. for four hours. Subsequently, the resultant alloy source was subjected to grinding treatment under the same conditions as those of Example 1. The amounts of particles were measured in a manner similar to that of Example 1. The results are shown in Table 1.

EXAMPLE 6

The same chromium-iron alloy source as employed in Example 1 was placed in an atmospheric furnace, and subjected to heat treatment in an argon gas atmosphere at 1,200° C. for four hours. Subsequently, the resultant alloy source was subjected to grinding treatment under the same conditions as those of Example 1. The amounts of particles were measured in a manner similar to that of Example 1. The results are shown in Table 1.

EXAMPLE 7

The same chromium-iron alloy source as employed in Example 1 was placed in an atmospheric furnace, and subjected to heat treatment in a hydrogen gas atmosphere at 850° C. for four hours. Subsequently, the resultant alloy source was subjected to grinding treatment under the same conditions as those of Example 1. The amounts of particles were measured in a manner similar to that of Example 1. The results are shown in Table 1.

EXAMPLE 8

The same chromium-iron alloy source as employed in Example 1 was placed in an atmospheric furnace, and subjected to heat treatment in a hydrogen gas atmosphere at 1,100° C. for four hours. Subsequently, the resultant alloy source was subjected to grinding treatment under the same conditions as those of Example 1. The amounts of particles were measured in a manner similar to that of Example 1. The results are shown in Table 1.

TABLE 1

| | Heat treatment atmosphere | Heat treatment temperature | Particles of 106 μm or less (mass %) | Particles of 75 μm or less (mass %) |
|---|---|---|---|---|
| Grinding source | — | — | 39 | 14 |
| Comp. Ex. 1 | — | No heat treatment | 49 | 41 |
| EX. 1 | Argon | 500° C. | 88 | 60 |
| EX. 2 | | 600° C. | 97 | 59 |
| EX. 3 | | 850° C. | 91 | 63 |
| EX. 4 | | 950° C. | 90 | 61 |
| EX. 5 | | 1050° C. | 91 | 62 |
| EX. 6 | | 1100° C. | 95 | 71 |
| EX. 7 | Hydrogen | 850° C. | 93 | 65 |
| EX. 8 | | 1100° C. | 93 | 65 |

As is clear from the results shown in Table 1, in Comparative Example 1 in which the grinding source is subjected to grinding without being subjected to heat treatment, the amount of particles having a size of 106 μm or less is increased from 39 mass % to 49 mass % through grinding of the source. In contrast, in Examples 1 through 8 in which the grinding source is subjected to heat treatment according to the method of the present invention, the amount of particles having a size of 106 μm or less is increased from 39 mass % to 88–97 mass % through grinding of the source. That is, the amount of particles having a size of 106 μm or less obtained in Examples 1 through 8 is 1.8 times to twice that of particles having a size of 106 μm or less obtained in Comparative Example 1. Therefore, in Examples 1 through 8, grindability of the grinding source is considerably improved as compared with the case of Comparative Example 1.

The results also show that, in Comparative Example 1 in which the grinding source is subjected to grinding without being subjected to heat treatment, the amount of particles having a size of 75 μm or less is increased to 41 mass % through grinding of the source. In contrast, in Examples 1 through 8 in which the grinding source is subjected to heat treatment according to the method of the present invention, the amount of particles having a size of 75 μm or less is increased to 59–71 mass % through grinding of the source. That is, the amount of particles having a size of 75 μm or less obtained in Examples 1 through 8 is 1.4 to 1.7 times that of particles having a size of 75 μm or less obtained in Comparative Example 1. Therefore, in Examples 1 through 8, grindability of the grinding source is improved as compared with the case of Comparative Example 1.

EXAMPLE 9

A chromium-iron-based alloy source similar to that employed in Example 1 was subjected to heat treatment in an argon gas atmosphere at 1,000° C. for two hours. After being cooled, the chromium-iron alloy source was subjected to grinding by use of an impact mill (ACM-10, product of Hosokawa Micron Corporation) including the grinding liner of the present invention.

A metallic cylindrical liner (318 mm, thickness: 8 mm) was employed in the impact mill of the present invention. Seventy-one bar-like, wear-resistant members formed of yttria-stabilized zirconia having a simple rectangular parallelepiped shape and having a length shorter than the height of the liner (dimensions of each member: 5 mm×8 mm×60 mm) were provided on the inner wall of the liner, such that the members were arranged to form a grating. The bar-like, wear-resistant members were provided on the inner wall at uniform intervals.

Four wear-resistant members formed of tungsten carbide-cobalt, each having a length of 40 mm at a side that impacts an object to be ground, a length of 33 mm at the opposite side, a width of 29 mm, and a thickness of 16 mm, were provided on the upper surface of a grinding rotor at uniform intervals. Grinding was carried out while the grinding rotor was rotated at 6,500 rpm.

Particles obtained through grinding by use of the impact mill of the present invention were subjected to classification, to thereby produce a powder having a particle size of 38 to 8 μm.

EXAMPLE 10

Heat treatment and grinding were carried out in a manner similar to that of Example 9, and subsequently classification was carried out, to thereby produce a powder having a particle size of 45 to 10 μm.

EXAMPLE 11

Heat treatment and grinding were carried out in a manner similar to that of Example 9, and subsequently classification was carried out, to thereby produce a powder having a particle size of 53 to 10 μm.

COMPARATIVE EXAMPLE 2

A chromium-iron-based alloy source similar to that employed in Example 1 was subjected to heat treatment in a hydrogen gas atmosphere at 1,000° C. for two hours. After being cooled, the chromium-iron alloy source was subjected to grinding for one hour by use of a vibration mill (product of Chuo Kakohki Co., Ltd.) including 220 SUS 304 rods (18φ×585 L) serving as a grinding means, and then classification was carried out, to thereby produce a powder having a particle size of 38 to 8 μm.

COMPARATIVE EXAMPLE 3

Heat treatment and grinding were carried out in a manner similar to that of Comparative Example 2, and subsequently classification was carried out, to thereby produce a powder having a particle size of 45 to 10 μm.

COMPARATIVE EXAMPLE 4

Heat treatment was carried out in a manner similar to that of Comparative Example 2, and then grinding was carried out for 1.5 hours by use of an attritor (product of Mitsui Miike Kakoki) including 10-φ steel balls (350 Kg) serving as a grinding means. Subsequently, classification was carried out to thereby produce a powder having a particle size of 45 to 10 μm.

COMPARATIVE EXAMPLE 5

A chromium-iron-based alloy source which had not been subjected to heat treatment was subjected to grinding for 1.5 hours by use of an attritor (product of Mitsui Miike Kakoki) including 10-φ steel balls (350 Kg) serving as a grinding means, and then subjected to classification, to thereby produce a powder having a particle size of 53 to 10 μm.

Figure 3:
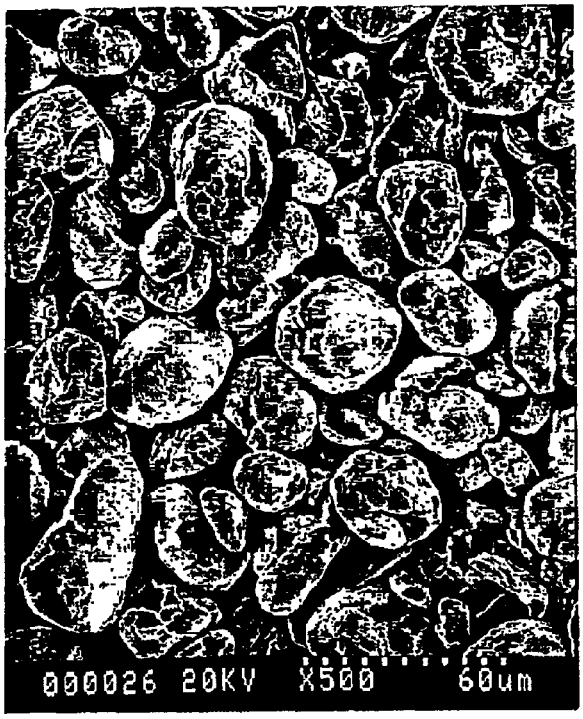
FIG. 3 shows a scanning electron micrograph of a powder produced in Example 10.
Figure 4:
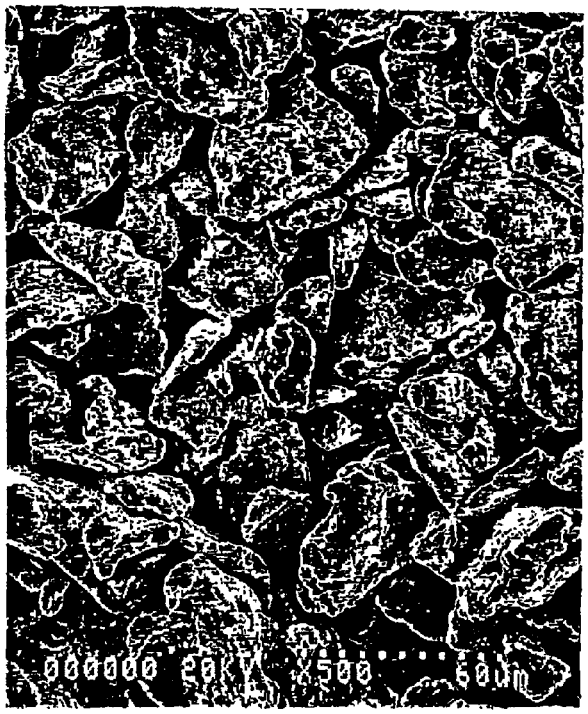
FIG. 4 shows a scanning electron micrograph of a powder produced in Comparative Example 3.

Table 2 shows the apparent densities (Z2504) of the powders produced in Examples 9 through 11 and Comparative Examples 2 through 5. The results show that the metallic powder which is subjected to heat treatment and impact grinding according to the method of the present invention has an apparent density as specified by JIS of 2.8 or more. As described above, when particles of a powder have a round shape, the powder has such a high apparent density. When such a powder is employed for spray coating, the powder exhibits stable fluidity during spray coating, and a uniform coating can be formed. FIG. 3 shows a scanning electron micrograph (SEM) of the powder produced in Example 10. FIG. 4 shows an SEM of the powder produced in Comparative Example 3.

TABLE 2

| | Grinding means | Apparent density at different particle sizes 38–8 μm | 45–10 μm | 53–10 μm |
|---|---|---|---|---|
| Ex. 9 | Impact mill | 2.9 | | |
| Comp. Ex. 2 | Vibration mill | 2.7 | | |
| Ex. 10 | Impact mill | | 3.2 | |
| Comp. Ex. 3 | Vibration mill | | 2.7 | |
| Comp. Ex. 4 | Attritor | | 2.5 | |
| Ex. 11 | Impact mill | | | 3.3 |
| Comp. Ex. 5 | Attritor | | | 2.2 |

COMPARATIVE EXAMPLE 6

Bar-like, wear-resistant members formed of stainless steel were provided on the inner wall of the liner of the impact mill employed in Example 9, such that the members were arranged to form a grating. Grinding was carried out under the same conditions as those of Example 9.

Table 3 shows relative comparison of grindability of the impact mill employed in Example 9 with that of the impact mill employed in Comparative Example 6, along with relative comparison of the amount of wear of the wear-resistant members provided on the inner wall of the liner of the impact mill employed in Example 9 with that of wear of the wear-resistant members provided on the inner wall of the liner of the impact mill employed in Comparative Example 6.

TABLE 3

| | Comparative Example 6 | Example 9 |
|---|---|---|
| Amount of wear (relative value) | 10200 | 100 |
| Grindability (relative value) | 84 | 100 |

When the impact mill of the present invention is employed, grindability of a chromium-iron-based alloy is enhanced, and the running cost of the impact mill is drastically lowered. In addition, the amount of contamination of the ground powder with a powder generated as a result of wear of the wear-resistant member is reduced, and the purity of the ground powder can be enhanced.

INDUSTRIAL APPLICABILITY

When the method for producing a chromium-iron-based thermal spraying material of the present invention is employed, grindability of a chromium-iron-based alloy can be improved considerably. When an impact mill, which has conventionally been problematic to use in practice from the viewpoints of running cost and contamination with impurities, is employed in the production method of the present invention, running cost can be reduced considerably, and the purity of a thermal spraying material to be produced can be enhanced.

Unlike the case where conventional batch grinding is carried out, when the impact mill of the present invention including an air classification mechanism is employed, the temperature of a ground product is not easily increased, and the ground product is not easily oxidized. Therefore, regulation of an atmosphere for preventing oxidation of the ground product—which is required for batch grinding—is not required in the method of the present invention, and thus grinding can be carried out in air, thereby further reducing running cost.

The powdery thermal spraying material produced through the method of the present invention has a round shape. Therefore, when the thermal spraying material is employed for spray coating, the powder exhibits stable fluidity during spray coating, and a uniform coating can be formed.

What is claimed is:

1. A method for producing a chromium-iron-based thermal spraying material characterized by comprising subjecting a chromium-iron-based alloy having a chromium content of about 60 to about 95 mass % to heat treatment, and subsequently subjecting the heat-treated alloy to grinding treatment.

2. A method for producing a chromium-iron-based thermal spraying material according to claim 1, wherein the chromium-iron-based alloy is in the form of particles having a size of about 5 μm to about 1 mm in diameter.

3. A method for producing a chromium-iron-based thermal spraying material according to claim 1, wherein the heat treatment of the chromium-iron-based alloy is carried out in an atmosphere of hydrogen gas or an inert gas.

4. A method for producing a chromium-iron-based thermal spraying material according to claim 3, wherein the inert gas is argon.

5. A method for producing a chromium-iron-based thermal spraying material according to claim 1, wherein the heat treatment of the chromium-iron-based alloy is carried out at about 500 to about 1,300° C.

6. A method for producing a chromium-iron-based thermal spraying material according to claim 1, wherein the grinding treatment is carried out by use of an impact mill.

7. A method for producing a chromium-iron-based thermal spraying material according to claim 6, wherein the impact mill includes a liner section having bar-like, wear-resistant members which are arranged to form a grating.

8. A method for producing a chromium-iron-based thermal spraying material according to claim 7, wherein the bar-like, wear-resistant members are formed from any one material selected from among zirconia, yttria-stabilized zirconia, calcia-stabilized zirconia, magnesia-stabilized zirconia, alumina, alumina-zirconia, silicon carbide, silicon nitride, and a tungsten carbide-cobalt alloy.

9. A method for producing a chromium-iron-based thermal spraying material according to claim 1, wherein a thermal spraying material produced through the method has a particle size of about 5 to about 100 μm.

10. A method for producing a chromium-iron-based thermal spraying material according to claim 1, wherein a thermal spraying material produced through the method has an apparent density as specified by JIS (Z2504) of about 2.8 to about 3.5 g/cm$^3$.

* * * * *